US009578908B2

(12) United States Patent
Berns et al.

(10) Patent No.: US 9,578,908 B2
(45) Date of Patent: Feb. 28, 2017

(54) APPAREL WITH WEAR INDICATOR

(71) Applicant: Under Armour, Inc., Baltimore, MD (US)

(72) Inventors: Jason A. Berns, Crofton, MD (US); Shannon Miller, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 963 days.

(21) Appl. No.: 13/852,689

(22) Filed: Mar. 28, 2013

(65) Prior Publication Data

US 2014/0115748 A1 May 1, 2014

Related U.S. Application Data

(60) Provisional application No. 61/616,935, filed on Mar. 28, 2012.

(51) Int. Cl.

| | |
|---|---|
| ***A41D 27/00*** | (2006.01) |
| ***G09F 3/02*** | (2006.01) |
| ***G09F 3/00*** | (2006.01) |
| ***A41C 3/00*** | (2006.01) |
| ***A43B 1/10*** | (2006.01) |
| ***A43B 13/04*** | (2006.01) |

(52) U.S. Cl.

CPC ..... *A41D 27/00* (2013.01); *A41C 3/0057* (2013.01); *A43B 1/10* (2013.01); *A43B 13/04* (2013.01); *G09F 3/0291* (2013.01)

(58) Field of Classification Search

CPC ..... A41D 27/00; A41D 27/08; G09F 3/02; G09F 3/0291; G09F 3/0292; G09F 3/094

USPC ..... 116/200, 206, 208

See application file for complete search history.

(56) References Cited

U.S. PATENT DOCUMENTS

| | | | | | |
|---|---|---|---|---|---|
| 3,542,519 | A * | 11/1970 | Kedzie | A46B 15/0002 | 116/200 |
| 5,040,313 | A * | 8/1991 | Simjian | A43B 3/00 | 36/114 |
| 5,313,909 | A * | 5/1994 | Tseng | A46B 15/001 | 116/200 |
| 5,513,448 | A * | 5/1996 | Lyons | A43B 13/182 | 36/27 |
| 5,985,383 | A * | 11/1999 | Allen | A42B 3/121 | 36/88 |
| 6,578,291 | B2 * | 6/2003 | Hirsch | A43B 3/0005 | 36/132 |
| 6,971,935 | B1 * | 12/2005 | Gilmer | A41D 13/0125 | 2/67 |

(Continued)

FOREIGN PATENT DOCUMENTS

| | | | | |
|---|---|---|---|---|
| FR | 2581665 | A1 * | 11/1986 | D02G 3/443 |
| FR | 2783959 | A1 * | 3/2000 | G01K 11/00 |

(Continued)

*Primary Examiner* — Richard A. Smith

(74) *Attorney, Agent, or Firm* — Maginot, Moore & Beck LLP

(57) ABSTRACT

A sports bra configured to be worn by a human female includes a body fabric and a wear indicator. The wear indicator is configured to change colors when the useful life of the sports bra has expired and the sports bra should be replaced with a new sports bra. The wear indicator may be provided on any of various components of the sports bra, such as a color band, trim feature, tag, or other sports bra component.

20 Claims, 3 Drawing Sheets

(56) References Cited

U.S. PATENT DOCUMENTS

| | | | | |
|---|---|---|---|---|
| 7,105,225 | B2 * | 9/2006 | Birkholz | B32B 7/12 428/343 |
| 7,353,770 | B2 * | 4/2008 | Sanguinetti | A43B 1/0027 116/200 |
| 2002/0061595 | A1 * | 5/2002 | Yabuki et al. | G01N 31/222 436/39 |
| 2005/0060811 | A1 * | 3/2005 | Smith | D06M 7/00 8/115.51 |
| 2006/0246802 | A1 * | 11/2006 | Hughes | B32B 3/10 442/327 |
| 2008/0279253 | A1 * | 11/2008 | MacDonald et al. | A41D 13/002 374/162 |
| 2009/0064919 | A1 * | 3/2009 | Greenwald | G08B 13/246 116/201 |
| 2009/0199857 | A1 * | 8/2009 | Peake | A61M 16/06 128/206.28 |
| 2009/0205775 | A1 * | 8/2009 | Lu | G09F 3/02 156/277 |
| 2013/0309478 | A1 * | 11/2013 | Trupp | D06M 23/12 428/221 |

FOREIGN PATENT DOCUMENTS

| | | | | |
|---|---|---|---|---|
| GB | 2243140 | A * | 10/1991 | G01K 11/12 |
| WO | WO 8603613 | A1 * | 6/1986 | D06F 93/005 |

* cited by examiner

APPAREL WITH WEAR INDICATOR

CROSS-REFERENCE TO RELATED APPLICATIONS

This application claims priority to U.S. provisional patent application No. 61/616,935, filed Mar. 28, 2012.

FIELD

This application relates to the field of garments and other apparel, including bras and shoes.

BACKGROUND

Athletic gear is commonly worn by individuals participating in athletic activities. For example, female athletes typically wear athletic shoes and a sports bra during an athletic activity. Sports bras are sturdier than typical bras, minimize breast movement, alleviate discomfort, and reduce potential damage to chest ligaments that may occur during physical exercise.

A sports bra will tend to wear over time with use and subsequent washing, thus reducing the elasticity and support offered by the sports bra. As a result of a sports bra with excessive wear, the wearer may encounter increased breast movement during exercise, increased discomfort, and an increased risk for damage to chest ligaments. Accordingly, sports bras should be replaced regularly.

The frequency at which a sports bra should be replaced is highly dependent upon how often the sports bra is worn and how it is cared for. The more a sports bra is washed and worn, the more often it should be replaced. Many trainers and sports bra manufacturers recommend replacing a sports bra any time from three months to a year, depending on how often the sports bra is worn. Others recommend replacing a sports bra after one hundred workouts and washings.

Unfortunately, it is inconvenient for women to keep track of the number of times a sports bra has been worn and washed. Even if a woman knows the date of purchase of a particular sports bra, she may have a number of sports bras in her wardrobe which may not have been worn equally. Therefore, unless the woman keeps detailed records of the date of each workout over a period of time and the sports bra worn during that work out, it is very difficult for the woman to know how many times a given sports bra has been worn and washed. As a result, far too much time often passes before a woman realizes that a sports bra is in need of replacement and the sports bra is replaced with a new sports bra. Many women will only replace a sports bra when they notice excessive bouncing of the breasts during a workout, a general lack of support, worn-out elastic straps or bands, or chafing fabric. By this time, damage may have resulted from continued use of a spent sports bra.

In view of the foregoing, it would be advantageous to provide a sports bra that provides a convenient method and apparatus for indicating that a sports bra should be replaced. It would also be advantageous if the replacement indicator were readily accessible and apparent to the wearer. Additionally, it would be advantageous if the replacement could be easily and inexpensively incorporated into the garment.

SUMMARY

In accordance with at least one exemplary embodiment, an article of apparel, and particularly a garment in the form of a sports bra configured to be worn by a human female includes a body fabric and a wear indicator. The wear indicator is configured to change colors when the useful life of the sports bra has expired and the sports bra should be replaced with a new sports bra. The wear indicator may be provided on any of various components of the sports bra, such as a color band, trim feature, tag, or other sports bra component.

In at least one exemplary embodiment, the wear indicator is provided by a first colored component on the sports bra that is covered by a second colored layer, such as a dye layer. The second colored layer is configured to fade with wear and washing of the sports bra. When the first color of the sports bra component is exposed, the wearer is provided with an indication that the sports bra should be replaced.

The above described features and advantages, as well as others, will become more readily apparent to those of ordinary skill in the art by reference to the following detailed description and accompanying drawings. While it would be desirable to provide a garment that provides one or more of these or other advantageous features, the teachings disclosed herein extend to those embodiments which fall within the scope of the appended claims, regardless of whether they accomplish one or more of the above-mentioned advantages.

DESCRIPTION

Figure 1:
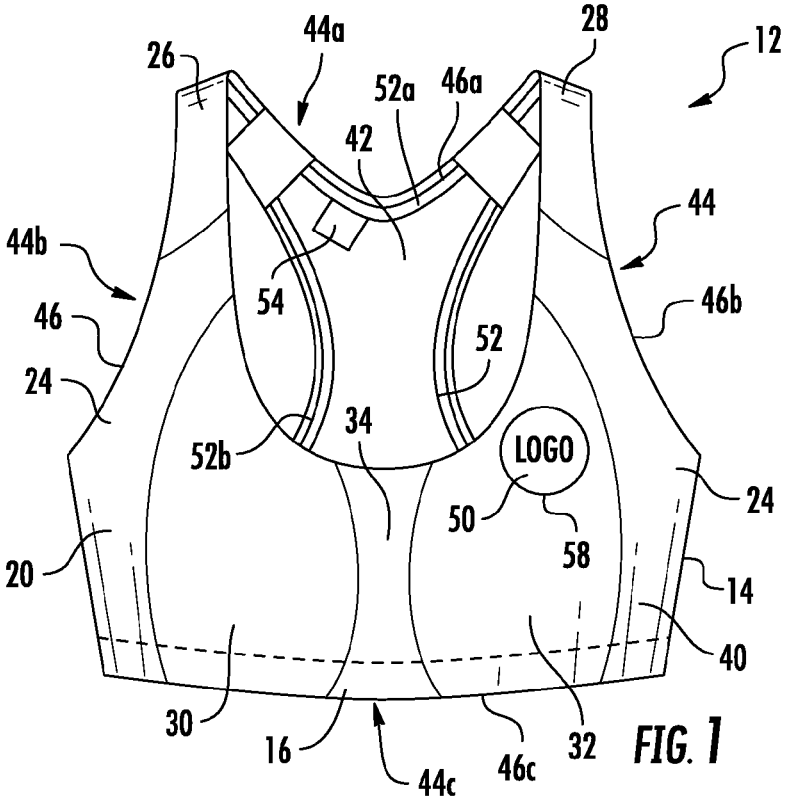
FIG. 1 shows a front view of a garment in the form of a sports bra including at least one wear indicator.
Figure 2:
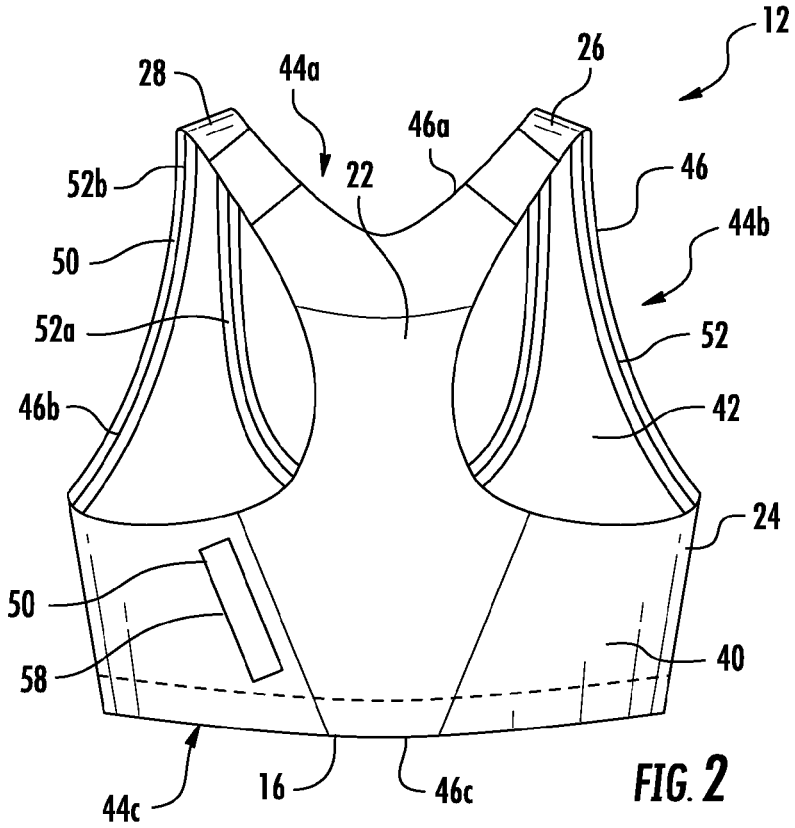
FIG. 2 shows a back view of the sports bra of FIG. 1.
Figure 3:
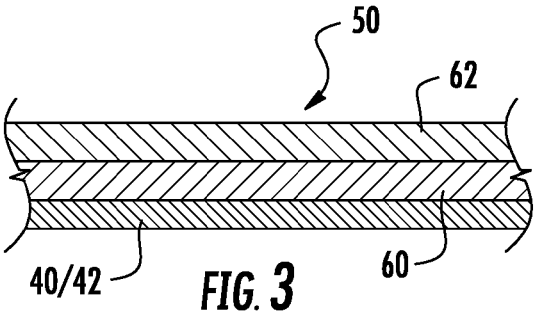
FIG. 3 shows a cross-sectional view of an exemplary embodiment of the wear indicator of FIG. 1.

With reference to FIGS. 1-3, a garment is shown in the form of a sports bra 12 that is configured to be worn by a human female. At least one wear indicator 50 is provided on the sports bra 12. In the exemplary embodiment of FIG. 2, the sports bra 12 includes a plurality of wear indicators 50, provided at different locations on the sports bra 12. As explained in further detail below, each wear indicator 50 is configured to change color when the sports bra 12 should be replaced as a result of repeated use and/or washing. Although the exemplary embodiment disclosed herein provides the wear indicator 50 as being incorporated on a sports bra, it will be recognized that in other embodiments the wear indicator may be positioned on different types of garments or items of apparel, including for example, shirts, shorts, pants, socks, shoes, hats, and other garments that may be used for various purposes. Additional examples of garments that may incorporate the wear indicator 50 disclosed herein include supportive or protective garments, such as garments with incorporated compression features or padding, including padded girdles or shorts, padded shirts, knee guards, elbow guards, sleeves, or any of various other protective or supportive garments.

In the exemplary embodiment of FIGS. 1-3, the sports bra 12 includes a frame 14 supported by an elastic band 16 that is configured to wrap around the torso of a woman. The frame 14 includes a front 20, a back 22, side portions 24, and two shoulder straps 26, 28. Two cups 30, 32 configured to support the woman's breasts are coupled to the band 16 on the front 20 of the frame. The cups 30, 32 are joined at the center of the front 20 by a gore 34. The shoulder straps 26, 28 extend from the top portion of the cups 30, 32 to the back 22 of the frame 14.

The sports bra 12 includes an outer surface 40, an inner surface 42, and a plurality of openings 44 configured to receive body parts of the wearer. In particular, the openings include a head opening 44*a*, two limb openings in the form of arm openings 44*b*, and a torso opening 44*c*. The openings 44 are designed and dimensioned to receive the associated body parts of the wearer and allow the wearer to don the sports bra 12. In particular, when donning the sports bra 12, the wearer inserts her head through the head opening 44*a* (via the torso opening 44*c*), and inserts her arms through the arm openings 44*b*. As a result, the wearer's torso is received by the torso opening 44*c*. Each of the plurality of openings 44 is defined by an associated perimeter 46, including perimeters 46*a*-46*c*, and the outer surface 40 is separated from the inner surface 42 along such perimeters 46.

The outer surface 40 of the sports bra 12 is configured to face away from the human female wearing the garment. The outer surface 40 is substantially comprised of one or more fabric portions. The fabric portions may be comprised any of various natural or synthetic materials, including cotton, wool, polyester, nylon, blends thereof, or other materials as are commonly used in garments. In at least one exemplary embodiment, the fabric on the outer surface of the sports bra 12 includes elastane fibers, or other elastic fibers configured to give the fabric an elastic quality. The fabric portions may be provided on the front 20, back 22, and/or side portions 24 of the sports bra 12.

The inner surface 42 of the sports bra 12 is positioned opposite the outer surface 40 and is configured to face toward the human female wearing the garment. Similar to the outer surface 40, the inner surface 42 of the sports bra 12 is also comprised of one or more fabric portions. The fabric portions may be comprised any of various natural or synthetic materials, including cotton, wool, polyester, nylon, blends thereof, or other materials as are commonly used in garments. In at least one exemplary embodiment, the fabric on the outer surface of the sports bra 12 includes elastane fibers, or other elastic fibers configured to give the fabric an elastic quality. One or more of the above-described fabric portions may be referred to herein as the "body portion" or "body fabric", and may reference fabric portions on either the outer surface 40 or inner surface 42 of the sports bra 12.

At particular locations on the sports bra 12, the inner surface 42 and outer surface 40 of the garment may be provided by opposite sides of a single fabric portion. For example, in the exemplary embodiment of FIGS. 1-3, the back 22 may be provided by a single layer mesh fabric configured to offer ventilation on the back of the garment. Furthermore, at other locations on the garment, the garment may be comprised of a multi-layer fabric structure such that the inner surface 42 and the outer surface 40 of the sports bra 12 are provided by different fabric layers. For example, the cups 30, 32 on the front of the sports bra 12 may include an inner layer and an outer layer with a pocket formed in between the inner layer and the outer layer and a molded cup positioned in the pocket.

At least one wear indicator 50 is provided on the garment in association with some component of the sports bra 12. For example, the wear indicator may be provided in association with a trim strip 52 or other trim piece, the elastic band 16, a tag 54, a color band 58, or any of various other components on the inner surface 42 or outer surface 40 of the sports bra 12. Each wear indicator 50 is configured to change colors following a predetermined amount of use and/or washing. Accordingly, the wear indicator 50 provides the wearer with an indication of that the useful life of the sports bra 12 is spent and the sports bra 12 should be replaced.

With reference to FIG. 3, each wear indicator 50 may be provided by a colored layer 62 positioned on a component 60 of the sports bra. As mentioned above, the component 60 of the sports bra 12 may be a trim strip 52, elastic band 16, tag 54, decorative band 58, or any of various other components on the inner surface 42 or outer surface 40 of the sports bra 12. The bra component 60 has a first color, and the colored layer 62 has a second color that is substantially different from the first color (e.g., the second color may be a contrasting color to that of the first color such that the first color is readily visible when the second color begins to fade). The bra component 60 may be comprised of any of various materials that are commonly found on sports bras, such as, for example, polymer materials, nylon, cotton, wool, polyester, or blends thereof.

The colored layer 62 completely covers the bra component 60. The colored layer 62 is a second color that is substantially different from the first color on the bra component 60 under the colored layer 62. The colored layer 62 is configured to wear over time as a result of contact with human skin and with washing. In particular, the colored layer 62 is configured to wear following a predetermined amount of wear or washing. As the colored layer 62 wears, the associated second color fades, and the underlying first color on the bra component begins to show. When a significant amount of the colored layer is removed, the second color fades, and the wearer is provided with a visual indication based on excessive exposure of the first color under the colored layer. In particular, when the second color fades and the first color of the bra component 60 shows, the wear indicator 50 provides the wearer with an indication that the useful life of the garment has expired, and the garment should be replaced.

Unlike conventional sports bras, the wear indicator 50 on the sports bra 12 disclosed herein is configured to change from the second color to the first color before the fabric of the bra 12 is frayed and the bra 12 shows other visible signs of being spent and past its useful life. In particular, the wear indicator 50 is associated with some predetermined amount of wear indicating that the useful life of the sports bra 12 has expired. This predetermined amount of wear is determined by the manufacturer and will vary depending on the quality and make of the bra. For example, one bra may need to be replaced following 50 hours of typical combined washing and wear while another bra may need to be replaced following 100 hours of typical combined washing and wear. Also, the predetermined amount of wear may result in different lengths of useful life for different users. Thus, the colored layer 62 on the wear indicator may begin to fade at different times for two different users who have very different wear and use styles. For example, a first woman may only use the sports bra 12 for low-impact stretching and yoga activities, may not perspire much, and may hand wash the bra. A second woman may only use the sports bra 12 for high-impact aerobic and running activities, may perspire greatly, and may machine wash the bra on a normal setting. Because of these different use and washing styles, the total amount of wear and wash time that passes before the second color fades will be different for each user. However, because of the different uses and treatment, the wear indicator 50 will still provide a very good indication of when the useful life of the bra has expired and should be replaced.

In at least one exemplary embodiment, the colored layer 62 is provided on the bra component 60 using a dying process. In such an exemplary process the bra component 60 is contacted with a dye for a time sufficient to at least color the surface of the component 60 and also penetrate into a portion of the cross-sectional area associated with component 60 to provide a degree of dye penetration. The degree of dye penetration and the degree of dye fastness of a selected bra component 60 is coordinated with the wear characteristics of the bra component 60 so that a change in color or color intensity of the wear indicator 50 provides a reliable indication of deterioration of the sports bra 12 due to wear. Exemplary processes for dying the bra component 60 may be similar to those associated with wear indicators for toothbrushes, such as the processes described in U.S. Pat. No. 4,802,255 and U.S. Publication No. 2008/0256725.

In at least one alternative exemplary embodiment, the colored layer 62 could also or alternatively be provided on the bra component 60 by integrating a dye into plastic of the bra component 60 during the molding or extrusion process. In this exemplary embodiment, the dye may slowly leach out when exposed to skin and water, including water from perspiration and washing.

In view of the above-described exemplary configurations, the wear indicator 50 may be considered to include an inner portion having a first color (e.g., bra component 60) and an outer portion having a second color (e.g., colored layer 62) that completely covers the first color on the inner portion. In various exemplary embodiments, the outer portion may be integrally formed with the inner portion, or the outer portion may be separately or concurrently formed from the inner portion and affixed, adhered, bonded or otherwise attached thereto.

As mentioned previously, the wear indicator 50 may be provided on the sports bra 12 in any of various different forms and in any of various different positions. In at least one exemplary embodiment, at least one wear indicator 50 is provided in the form of a colored trim strip 52 configured to engage the skin of the wearer on the interior surface 42 of the sports bra 12, as shown in FIGS. 1-2. The trim strips 52 in the exemplary embodiment of FIGS. 1-3, including trim strips 52*a*-52*c* are strips of fabric that are adhered to or otherwise attached to the inner surface of the sports bra 12 and extend along the substantial length of the perimeter 46 of at least one of the openings 44. Trim strip 52*a* extends along the substantial length of the head opening perimeter 46*a*, trim strips 52*b* extend along the substantial length of the arm opening perimeters 46*b*, and trim strip 52*c* extends along the substantial length of the torso opening perimeter 46*c*. The trim strips 52*a* and 52*b* have a width between 0.25 cm and 1.5 cm. In addition, these trim strips 52*a* and 53*b* are comprised of a fabric material that is seam-free and includes anti-chafing features to provide comfort against the skin of the wearer. For example, in at least one exemplary embodiment, the trim strips 52*a* and 52*b* are fabric strips comprised of a cotton and polyester blend which also includes elastane fibers that impart elasticity to the trim strip. Similarly, the trim strip 52*c* that extends along the torso opening perimeter 46*c* may be comprised of the same fabric with a slightly larger thickness. For example, in one exemplary embodiment, the trim strip 52*c* may have a thickness between 1.5 cm and 3.0 cm.

Because of the strategic placement of the trim strips 52 on the interior surface 42 of the sports bra 12, the wear condition of the sports bra may not be readily ascertained by another human viewing the sports bra 12 on the wearer. In particular, once a woman dons the sports bra 12, the trim strips 52 engage the skin of the wearer, and are not visible from an exterior of the sports bra 12. Accordingly, wear information provided by the trim strips will not be visible to others when the sports bra is worn, as the wear indicator 50 (e.g., the trim strip 52) is in engagement with the woman's skin and is hidden from view on the inner surface of the sports bra 12.

In another exemplary embodiment, another wear indicator 50 may be provided on a tag 54 of the sports bra 12. This tag 54 may be provided in addition to or in lieu of any other wear indicators on the sports bra 12. The tag 56 may be a typical tag that is used to indicate a size and/or manufacturer of the sports bra 12. Furthermore, other alternative or additional or alternative wear indicators 50 may be provided on other locations on the sports bra. For example, in FIGS. 1-3, a wear indicator 50 may be provided in association with a size marker 56 which is a printed box or other marker on the interior surface 42 of the sports bra 12. Additionally, with continued reference to FIGS. 1-3, a wear indicator 50 may be provided on at least one logo 58 provided on the exterior surface 40 or interior surface 42 of the sports bra 12. Again, in various exemplary embodiments, the at least one wear indicator 50 may be provided in one of the above-described positions and configurations or in all of the above-described positions and configurations, or even in additional positions and configurations as will be recognized by those of ordinary skill in the art.

As explained above, sports bras have a life cycle and the wear indicator 50 provides an indication of when the sports bra should be replaced. Accordingly, a method of indicating wear for garments is disclosed with reference to the above-described sports bra 12 of FIGS. 1-3. The method involves placing a wear indicator on a sports bra 12 and then allowing a human to use the bra. With use over time, the human's skin will rub against the wear indicator 50. Additionally, perspiration from the wearer will degrade the outer colored layer 62 of the wear indicator 50. Moreover, when the sports bra 12 is washed, the water, detergents, and friction from the washing process will further fade or otherwise degrade the outer colored layer 62 on the wear indicator 50. Eventually, when the colored layer 62 degrades a sufficient amount, the wear indicator 50 will expose the first color on the component 60 underneath the colored layer 62, thus causing the wear indicator 50 to change from the original color when the wearer first purchased the sports bra. When the wear indicator 50 changes colors, the wearer is provided with an indication that the sports bra 12 should be replaced.

Figure 4:
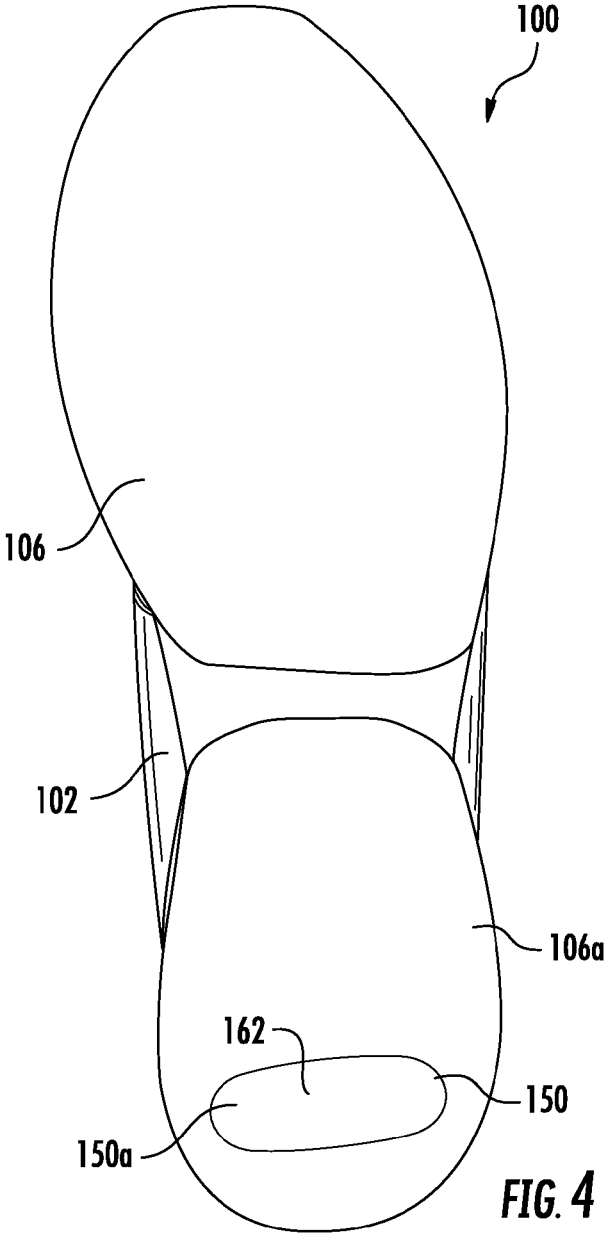
FIG. 4 shows a bottom view of an article of apparel in the form of a shoe including at least one wear indicator.
Figure 5:
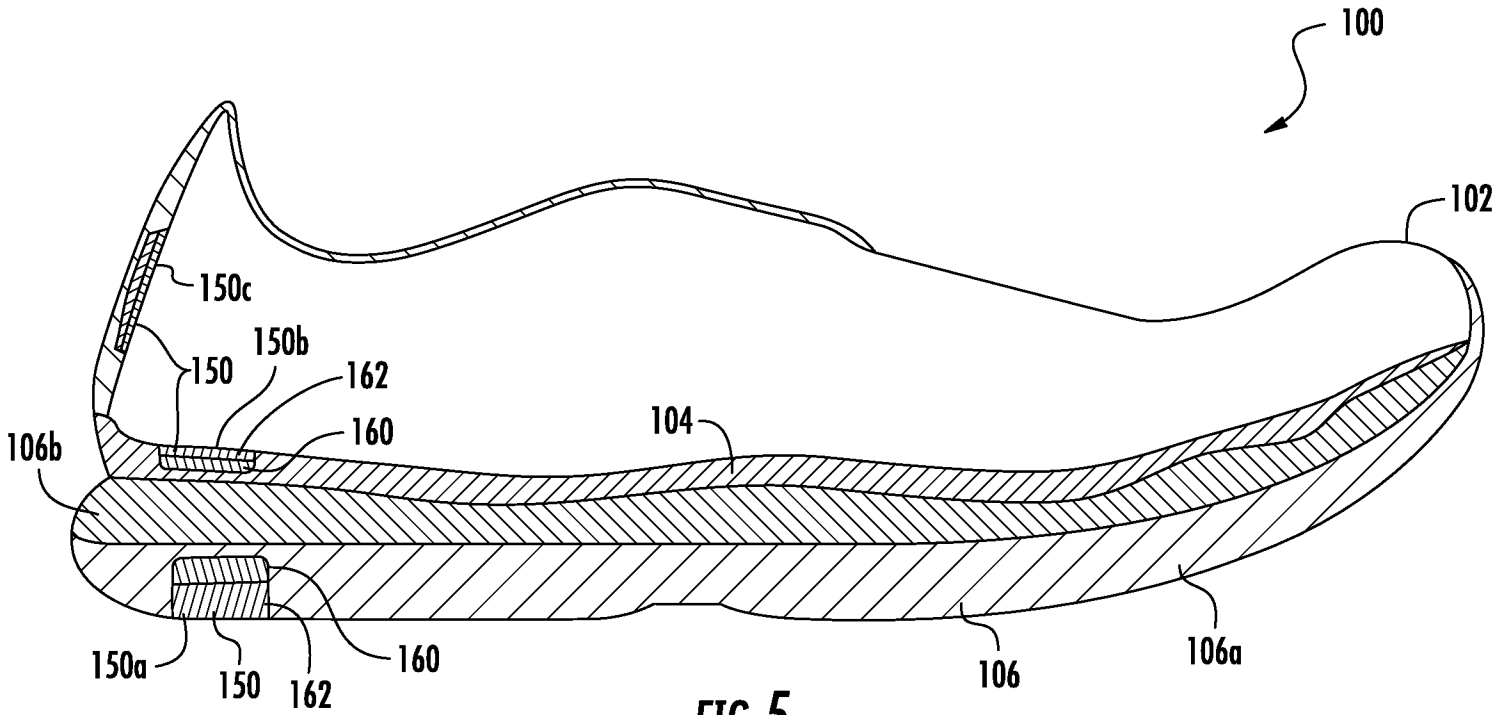
FIG. 5 shows a cross-sectional view of the shoe of FIG. 4.

Although the garment in the above-described exemplary embodiment is a sports bra, it will be recognized that the garment may also be provided in any of various other articles of apparel, such as other bras, shirts, pants, shorts, jackets, hats, shoes, etc. Accordingly, the term "article of apparel" as used herein refers to any garment or other article apparel configured to be worn on the body, including bras, shirts, pants, shorts, jackets, hats, shoes. At least one exemplary alternative embodiment of an article of apparel with a wear indicator 50 is shown in FIGS. 4 and 5. In this embodiment, the article of apparel is a shoe 100. The shoe includes a shoe upper 102, an insole 104, and an outsole 106. The shoe upper 102, insole 104, and outsole 106 may be comprised of any of various materials commonly associated with such portions of the shoe, including nylon, polyester, or other fabrics, leather, polymer materials, rubber, or any of various other materials as will be recognized by those of ordinary skill in the art. One or more of the above-described shoe portions may be referred to herein as the "body portion" of the shoe, and may reference portions provided on either and exterior or interior of the shoe 100.

As shown in FIGS. 4 and 5, the shoe 100 includes at least one wear indicator 150, similar to the wear indicator 50 described above. In the disclosed embodiment, the shoe 100 includes a first wear indicator 150*a* positioned on the outsole 106, a second wear indicator 150*b* positioned on the insole 104, and a third wear indicator 150*c* positioned on the shoe upper 102 and facing the foot cavity.

Each wear indicator includes a second layer 162 having a second color and a first layer 160 having a first color. The second layer 162 covers the first layer 160 and the second color is substantially different than the first color (e.g., the second color may be a contrasting color to that of the first color such that the first color is readily visible when the second color begins to fade). The second layer 162 is configured to wear over time as a result of repeated use of the shoe 100. In particular, the colored layer 162 is configured to wear following a predetermined amount of use. As the second layer 162 wears, the associated second color fades, and the underlying first color on the wear indicator 150 begins to show. When a significant amount of the second layer 162 wears away, the second color fades, and the wearer is provided with a visual indication based on excessive exposure of the first color of the first layer 160 on the shoe 100. In particular, when the second color fades and the first color of the wear indicator 150 shows, the wear indicator 150 provides the wearer with an indication that the useful life of the shoe has expired, and the shoe should be replaced.

It will be recognized that the wear indicator 150 is a component on the shoe 100 that is separate from other components and is specifically designed to indicate some predetermined amount of wear. For example, in the exemplary embodiment of FIG. 5, the outsole 106 includes an outer portion 106*a* that covers an inner portion 106*b*. Even if the inner portion 106*b* is a different color than the outer portion 106*a*, the wear indicator 150*a* is provided by a portion located only within the outer portion 106*a*, thus providing the wearer with an indication of wear on the outer portion 106*a* before the wear on the outer portion 106*a* is so extreme to wear completely through to the inner portion 106*b* of the outsole. Thus, in the exemplary embodiment of FIG. 5, the wear indicator 150*a* is provided as two colored layers on a component of the shoe 100 that otherwise has only a single color. Furthermore, the wear indicator 150*a* is only a relatively small portion of the total exposed surface area of the outer portion 106*a* of the outsole 106.

The foregoing detailed description of one or more exemplary embodiments of the garment with color coding has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed exemplary embodiments and other features and functions, or alternatives thereof, may be desirably combined into many other different embodiments, systems or applications. Furthermore, presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the exemplary embodiments contained herein.

What is claimed is:

1. An article of apparel comprising:

a body portion; and a wear indicator coupled to the body portion, the wear indicator configured to change colors following a predetermined amount of wear and washing indicating that a useful life of the article of apparel has expired and the article of apparel should be replaced, wherein the wear indicator is provided as a first colored component on the article of apparel covered by a second colored layer, and the second colored layer is configured to fade with the predetermined amount of wear and washing of the article of apparel and expose the first colored component indicating that the article of apparel should be replaced.

2. The article of apparel of claim 1 wherein the predetermined amount of wear is associated with a predetermined time of use and washing for a typical wearer.

3. The article of apparel of claim 1 wherein the second colored layer is a dye layer.

4. The article of apparel of claim 3 wherein the dye layer is integrated into a plastic component on the article of apparel.

5. The article of apparel of claim 3 wherein the dye layer is provided on a fabric portion of the article of apparel.

6. The article of apparel of claim 1 wherein the wear indicator is provided on an inner surface of the article of apparel.

7. The article of apparel of claim 6 wherein the wear indicator is provided on a tag of the article of apparel.

8. The article of apparel of claim 1 wherein the wear indicator is provided on an outer surface of the article of apparel.

9. The article of apparel of claim 1 wherein the wear indicator is provided by a logo on the article of apparel.

10. The article of apparel of claim 1 wherein the wear indicator is provided on a trim feature of the article of apparel, the trim feature extending along a perimeter of an opening in the garment.

11. The article of apparel of claim 1 wherein the wear indicator is provided on a color band of the article of apparel.

12. The article of apparel of claim 1 wherein the wear indicator is configured to contact skin of a wearer.

13. The article of apparel of claim 1 wherein the article of apparel is a shoe and the wear indicator is provided on a sole of the shoe.

14. The article of apparel of claim 1 wherein the article of apparel is a non-footwear article of apparel.

15. A sports bra comprising:

a body fabric; and a wear indicator coupled to the body fabric, the wear indicator including an inner portion having a first color and an outer portion having a second color completely covering the first color on the inner portion, the outer portion exposed on the sports bra, the second color on the outer portion configured to fade with a predetermined amount of wear and washing of the sports bra and expose the first color on the inner portion wherein exposure of the first color on the inner portion of the wear indicator indicates that the sports bra should be replaced.

16. The sports bra of claim 15 wherein the outer portion of the wear indicator is a dye layer integrated with the inner portion of the wear indicator.

17. The sports bra of claim 15 wherein the wear indicator is provided on an inner surface of the sports bra and is configured to contact skin of a wearer.

18. A method of indicating that a useful life of a garment is expired, the garment configured to be worn on a portion of a body other than a foot, the method comprising:

wearing the garment on a portion of a body other than a foot, the garment including a wear indicator coupled to the fabric of the garment, the wear indicator including an inner portion having a first color and an outer portion having a second color completely covering the first color on the inner portion, the outer portion exposed to a wearer of the garment; and indicating that the useful life of the garment has expired by exposing the first color under the second color on the wear indicator, the second color configured to fade with a predetermined amount of wear and washing of the garment and expose the first color on the inner portion of the wear indicator, wherein exposure of the first color on the inner portion of the wear indicator indicates that the garment should be replaced.

19. The method of claim 18 further comprising washing the garment after wearing the garment and before indicating that the useful life of the garment has expired.

20. The article of apparel of claim 18 further comprising engaging the wear indicator with skin on the body.

* * * * *